US005867182A

United States Patent [19]

Nakagawa

[11] Patent Number: 5,867,182

[45] Date of Patent: Feb. 2, 1999

[54] RECORDING APPARATUS INCLUDING RECORDING HEAD PROVIDED WITH A CHARACTER GENERATOR

[75] Inventor: Yoshihiro Nakagawa, Tokyo, Japan

[73] Assignee: Canon Kabushiki Kaisha, Tokyo, Japan

[21] Appl. No.: 247,454

[22] Filed: May 23, 1994

Related U.S. Application Data

[63] Continuation of Ser. No. 870,114, Apr. 17, 1992, abandoned, which is a continuation of Ser. No. 547,847, Jul. 3, 1990, abandoned.

[30] Foreign Application Priority Data

Jul. 5, 1989 [JP] Japan ..... 1-171881

[51] Int. Cl.[6] ..... B41J 2/05

[52] U.S. Cl. ..... 347/9; 347/49

[58] Field of Search ..... 347/9, 5, 57, 58, 347/59, 49; 395/110, 108

[56] References Cited

U.S. PATENT DOCUMENTS

| | | | |
|---|---|---|---|
| 3,453,647 | 7/1969 | Bernstein | 346/76 PH |
| 3,700,852 | 10/1972 | Ruggiero | 346/76 PH X |
| 3,787,884 | 1/1974 | Demer | 347/37 |
| 3,813,513 | 5/1974 | Vora | 346/76 PH X |
| 3,964,591 | 6/1976 | Hill | 346/75 X |
| 4,024,941 | 5/1977 | Sekikawa . | |
| 4,030,408 | 6/1977 | Miwa | 346/76 PH X |
| 4,030,588 | 6/1977 | Hanagata | 347/37 X |
| 4,059,183 | 11/1977 | Hoskins | 347/12 X |
| 4,268,179 | 5/1981 | Long | 346/76 PH X |
| 4,313,124 | 1/1982 | Hara . | |
| 4,344,079 | 8/1982 | Chambors | 347/40 |
| 4,345,262 | 8/1982 | Shirato et al. . | |
| 4,350,448 | 9/1982 | Hanagata | 346/76 PH X |
| 4,353,079 | 10/1982 | Kawanabe | 347/57 |
| 4,364,060 | 12/1982 | Jinnai | 347/40 X |
| 4,375,922 | 3/1983 | Maegawa | 400/70 |
| 4,386,862 | 6/1983 | Kittel et al. . | |
| 4,459,600 | 7/1984 | Sato et al. . | |
| 4,463,359 | 7/1984 | Ayata et al. . | |
| 4,465,386 | 8/1984 | Shimada | 400/121 |
| 4,516,139 | 5/1985 | Takiguchi | 347/43 |
| 4,549,222 | 10/1985 | Fogaroli | 358/296 |
| 4,558,333 | 12/1985 | Sugitani et al. . | |
| 4,723,129 | 2/1988 | Endo et al. . | |
| 4,730,185 | 3/1988 | Springer | 340/701 |
| 4,740,796 | 4/1988 | Endo et al. . | |
| 4,763,281 | 8/1988 | Arakawa . | |
| 4,983,989 | 1/1991 | Komuro | 347/211 X |

FOREIGN PATENT DOCUMENTS

| | | | |
|---|---|---|---|
| 3233425 | 4/1984 | Germany | B41J 3/10 |
| 59-123670 | 7/1984 | Japan | B41J 3/04 |
| 59-138461 | 8/1984 | Japan | B41J 3/04 |
| 2193162 | 2/1988 | United Kingdom | B41J 3/12 |

*Primary Examiner*—Joseph W. Hartary
*Attorney, Agent, or Firm*—Fitzpatrick, Cella, Harper & Scinto

[57] ABSTRACT

There is disclosed a recording head having recording elements for image recording on a recording medium, a character generator for generating a character pattern corresponding to address data, and a driver for driving the recording elements according to the character pattern from the character generator, thereby effecting recording on the recording medium. Also disclosed in a recording apparatus utilizing such recording head. The recording apparatus includes a control unit for controlling recording. With the recording head of the present invention, the control unit is required to process less data than that which a control unit used with a conventional recording head is required to process.

6 Claims, 7 Drawing Sheets

START
S301
RECEIVE DATA
S302
1 LINE OF DATA RECEIVED ?
NO
YES
FORM TEXT BUFFER
S303
START CARRIAGE
S304
READ 1 CHR FROM TEXT BUFFER
S305
COMPUTE CG ADDRESS
S306
TRANSFER CG ADDRESS TO HEAD
S307
S308
HEAD REACHED RECORDING POSITION ?
NO
YES
RECORD 1 COL.
S309
S310
1 CHR RECORDED ?
NO
S313
UPDATE CG ADDRESS
YES
S311
1 LINE RECORDED ?
NO
YES
STOP CARRIAGE
S312
END

FIG. 5 - PRIOR ART
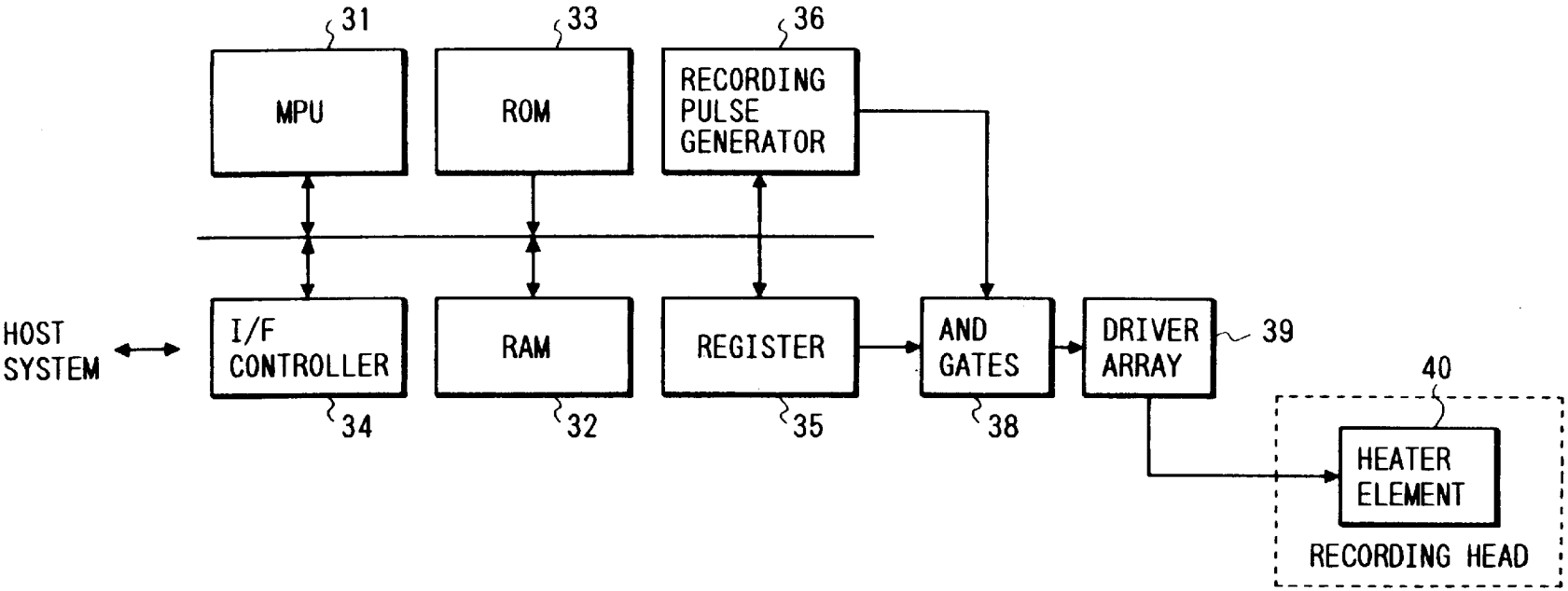

FIG. 6 - PRIOR ART
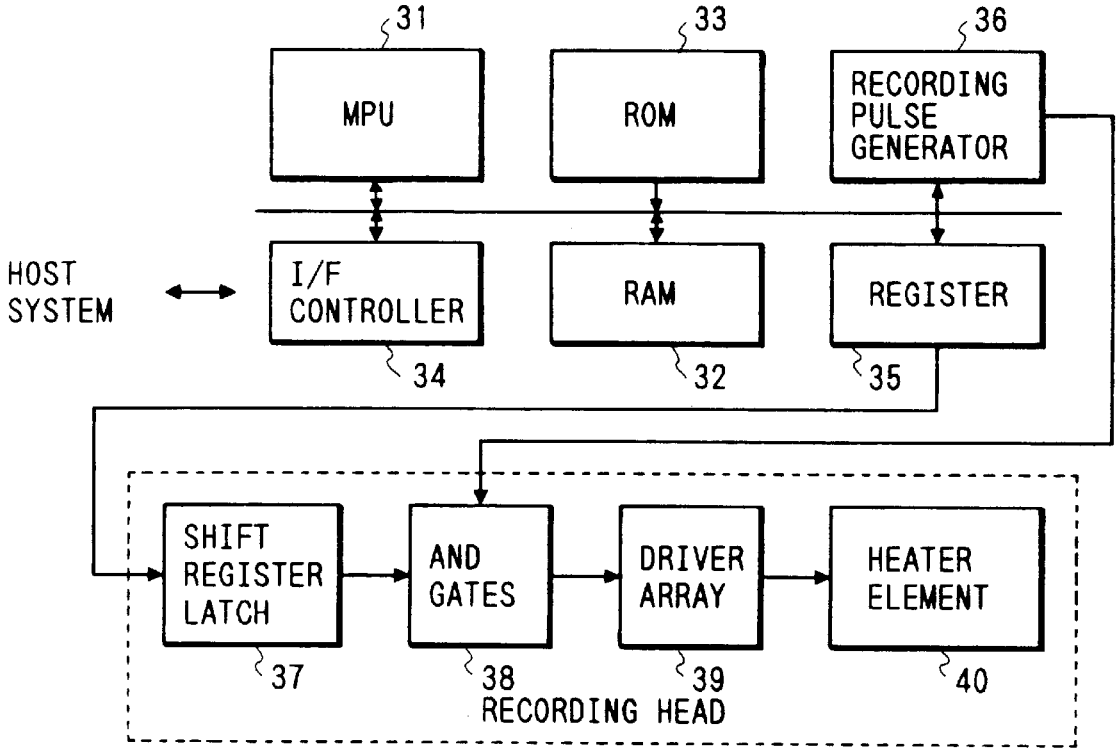

FIG. 7B - PRIOR ART
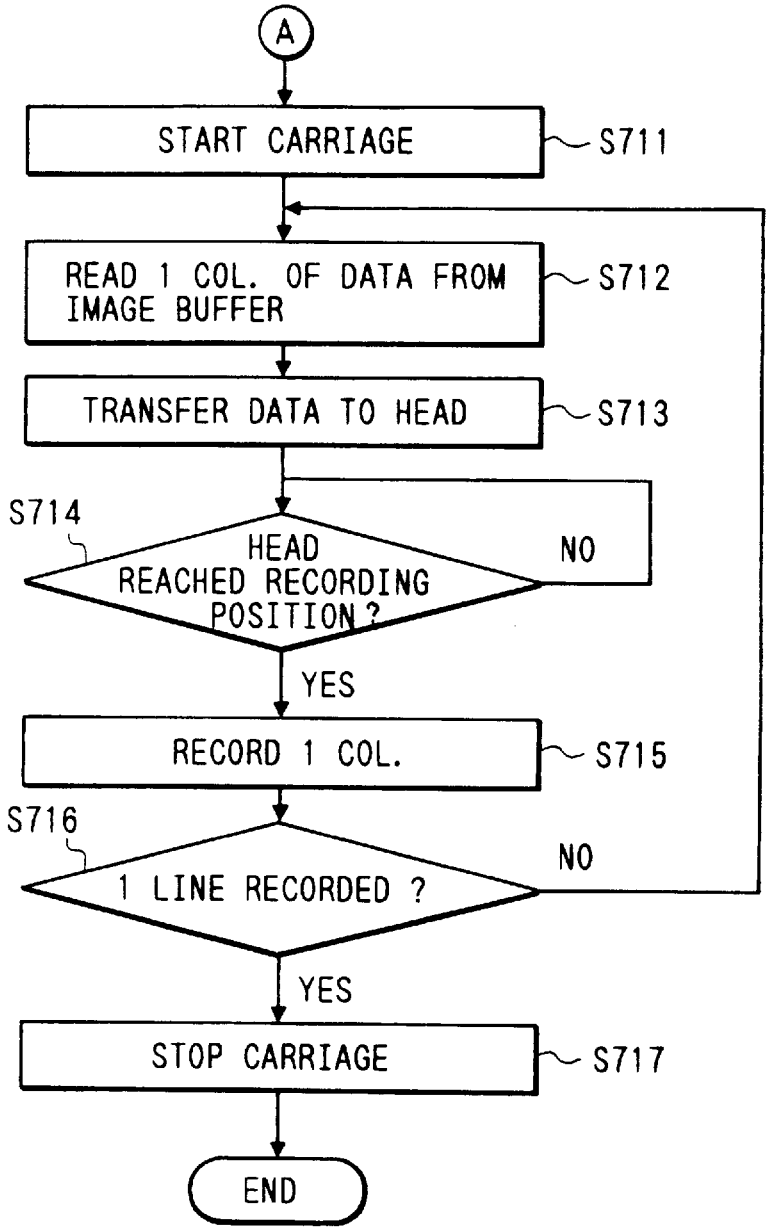

RECORDING APPARATUS INCLUDING RECORDING HEAD PROVIDED WITH A CHARACTER GENERATOR

This application is a continuation of application Ser. No. 07/870,114 filed Apr. 17, 1992, now abandoned, which is a continuation of application Ser. No. 07/547,847 filed Jul. 3, 1990, now abandoned.

BACKGROUND OF THE INVENTION

1. Field of the Invention

The present invention relates to a recording head and a recording apparatus in which said recording head is mounted for effecting a recording operation, and more particularly a recording head equipped with a character generator for enabling character recording and a recording apparatus utilizing such recording head.

2. Related Background Art

For recording characters and numerals in a recording apparatus, there is generally employed a character generator composed for example of a ROM for generating character patterns, and the recording of such characters and numerals is achieved by the activation of recording elements of a recording head according to said generated patterns.

On the other hand, ink jet recording apparatuses are becoming popular among various recording apparatuses. Particularly the ink jet recording apparatus of the type in which each recording element is composed of an ink discharge opening, an ink liquid path communicating therewith and an electrothermal converter (hereinafter also called heater element) provided in said ink liquid path, and in which a bubble is generated in the ink by the heat generated by the electrothermal converter and the ink discharge is caused by the state change of ink resulting from expansion or contraction of said bubble, is attracting attention in recent years, because of the possibilities of high-density arrangement of the electrothermal converters and of high-speed recording.

FIG. 5 is a block diagram of a conventional structure for driving the recording head of the above-explained type.

A microprocessor unit (MPU) 31 reads bit map pattern data constituting a character, based on a character code, from a character generator (CG) formed in a ROM 33 connected to the MPU through a bus, and stores said data in an image buffer in a RAM 32. Upon completion of reading and storage of data of a line to be recorded on a recording medium, such as recording paper, the MPU 31 reads, from said RAM 32, the data of a number corresponding to that of the heater elements 40 of the recording head, and stores said data in a register 35. A recording pulse generator 36 generates head driving pulses at timings in consideration of the relative movement of the recording head and the recording medium. AND gates 38 release AND signals of said pulses and the output signals of the register 35, thus selectively driving the heater elements 40 of the recording head through a driver array 39 and effecting the recording operation.

FIG. 6 is a block diagram showing another conventional structure.

The structure shown in FIG. 6 is different from that in FIG. 5 in that the recording head is equipped with a driver array 39, AND gates 38 and a shift register/latch 37 for serial data transfer in addition to the heater elements, whereas the recording head shown in FIG. 5 has the heater elements 40 only.

FIG. 7 is a flow chart showing the recording operation with the structure shown in FIG. 6, which is basically same as that of the structure shown in FIG. 5.

Steps S701–S703 receive data from a host system through an I/F controller 34, and prepare a text buffer in the RAM 32. Then a step S704 reads the code of a character from the text buffer, and subsequent steps S705, S706, S707 calculate the character generator address from said code, read the corresponding CG data and store said data in the image buffer.

Upon completion of storage of the data of a line into the image buffer in steps S708, S709, S710, a step S711 starts a carriage on which the recording head is mounted, and steps S712–S715 effect transfer and recording of data of a column corresponding to the heater elements 40 arranged on the recording head, in synchronization with the movement of the recording head. When the recording of a line is completed in a step S716, a step S717 stops the carriage at a home position, thereby terminating the recording of a line.

As explained in the foregoing, in the structure shown in FIG. 5, the recording head is equipped only with the heater elements, while other components such as driver are provided on a circuit board in the main body of the recording apparatus. Such structure is generally adopted for recording with a low resolving power, for a recording head with a relatively limited number of recording elements, or for reducing the cost of a disposable recording head.

On the other hand, in the structure shown in FIG. 6, the recording head is equipped with the driver, shift register/latch for serial data transfer and AND gates. Such structure, capable of serial data transfer to the recording head, allows to reduce the number of signal lines between the recording head and the main body of apparatus, in comparison with that in case of structure shown in FIG. 5. Moreover, it is capable of easy control of the signal transfer timing, because of the presence of the latch for the output of the shift register. Such structure is effective for reducing the number of lines in case of recording with a high resolving power or a case of recording head with a relatively large number of recording elements.

However the structure shown in FIG. 5, though being suitable for a disposable recording head of relatively simple structure, requires a high-speed MPU if the number of recording elements or the resolving power is increased, because the number of accesses of the MPU 31 to the CG or RAM 32, and the capacity of the RAM 32 has also to be increased according to the increase in the number of recording elements or in the resolving power. Such change will elevate the cost of the MPU or of the entire apparatus, and may eventually lead to a loss in the throughput of recording operation.

Also the number of lines connecting the recording head with the circuit board of the main body including the MPU 31 etc. increases with the increase in the number of recording elements or in the resolving power, thus elevating the cost and causing difficulty in the connecting operation in the mounting of the recording head.

Also if a font is desired other than the standard font stored in the CG of the ROM 33, there is often used an optional font cartridge. Such solution however results in drawbacks of requiring a connector for such font cartridge and a space in the apparatus for such font cartridge.

On the other hand, in the structure shown in FIG. 6, the amount of transferred data or the driving frequency of the recording head has to be increased in case of recording with a high resolving power or using a recording with an increased number of recording elements, and the serial data transfer becomes insufficient in the data transfer rate.

SUMMARY OF THE INVENTION

In consideration of the foregoing, an object of the present invention is to provide a recording head provided therein with a character generator thereby reducing the amount of data processed in a control unit such as an MPU and thus reducing the burden of said control unit, also thereby enabling to realize a high resolving power or a large number of recording elements in the recording head, furthermore reducing the number of lines connecting said recording head with the main body of the apparatus, and enabling to use other fonts than the standard one without increase in the number of lines or in the space by the replaceable structure of the recording head, and a recording apparatus adapted for use with such recording head.

Another object of the present invention is to provide a recording head having recording elements for recording on a recording medium, a character generator for releasing a character pattern corresponding to address data, and recording element driving means for driving said recording elements according to the character pattern from said character generator thereby effecting recording on the recording medium, and a recording apparatus equipped with recording head drive control means for transferring, to the recording head, address data corresponding to characters of the data to be recorded.

Still another object of the present invention is to provide a recording apparatus having support means for detachably supporting said recording head, and connection means for making connection for address data transfer in the supported state of the recording head.

Still another object of the present invention is to provide a recording apparatus in which the character generator is provided on the recording head, whereby the head drive control means, for example an MPU, is only required to transfer the address data for the character generator but is relieved from other processes such as reading of character generator data and storage thereof into the buffer.

Still another object of the present invention is to provide a recording apparatus in which an ordinary MPU can be employed for recording with a high resolving power or for a recording head with an increased number of recording elements.

Still another object of the present invention is to provide a recording apparatus capable of reducing the amount of data to be transferred to the recording head, thereby reducing the number of lines connecting the recording head with the main body of the apparatus.

Still another object of the present invention is to provide a recording apparatus in which the recording head is rendered detachable and is interchanged during use, whereby the content of the character generator can be changed and the recording can be executed with different fonts.

BRIEF DESCRIPTION OF THE DRAWINGS

FIGS. 5 and 6 are block diagrams respectively showing a conventional ink jet recording head and a conventional circuit for driving said recording head.

DETAILED DESCRIPTION OF THE PREFERRED EMBODIMENTS

Now the present invention will be clarified in greater detail by embodiments thereof shown in the attached drawings.

Figure 1:
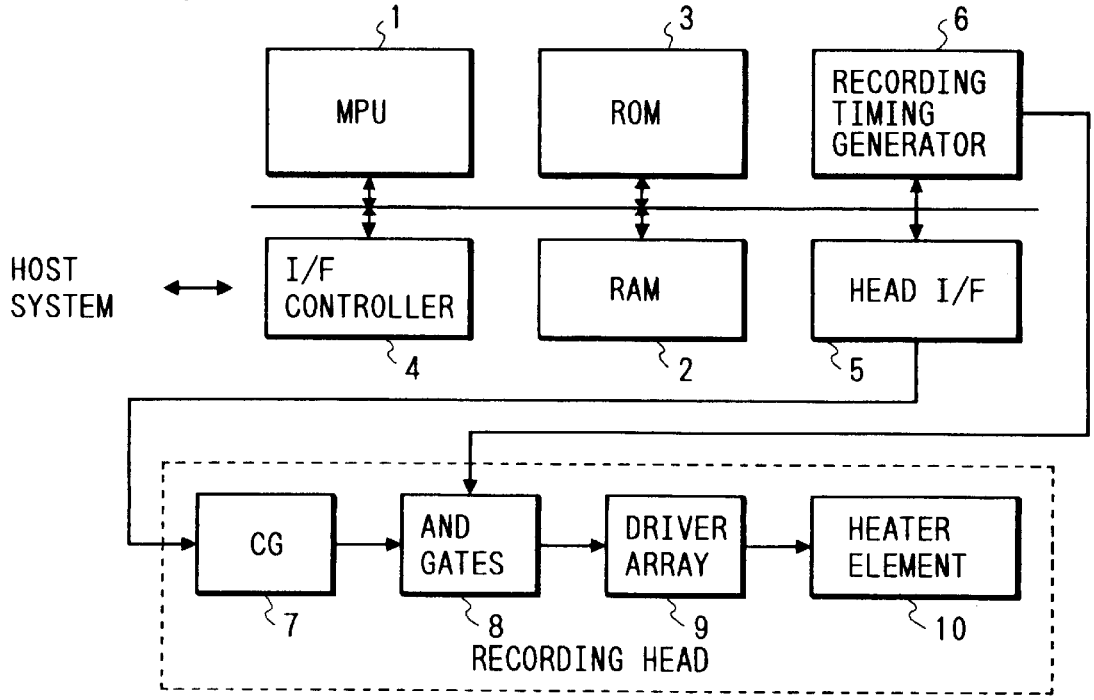
FIG. 1 is a block diagram of an ink jet recording head and a circuit for driving said recording head, in an embodiment of the present invention.

FIG. 1 is a block diagram of an ink jet recording head and a drive control unit for driving said recording head according to recording data, constituting an embodiment of the present invention.

In FIG. 1, there are shown an MPU 1 for controlling the entire apparatus; a RAM 2 used as a work area for buffering of input data or for storage of character code data of a line; a ROM 3 for storing a firmware for the MPU 1; an I/F control circuit 4 for interfacing with a host system; a head I/F unit 5 for interfacing between the recording head and the MPU 1; a recording timing generator 6 for generating the drive timing signal for heater elements of the recording head; a character generator (CG) ROM 7 storing character patterns of a work length corresponding to the heater elements of the recording head; AND gates 8 for supplying on/off signals to the heater elements by the outputs of the CGROM 7 and the recording timing generator 6; a driver array 9 for driving the heater elements by the outputs of said AND gates; and heater elements 10 provided respectively corresponding to discharge openings arranged on a discharge opening face of the recording head and adapted to generate bubbles by the generated heat, thereby discharging ink droplets by pressure change in the ink resulting from expansion or contraction of said bubbles.

Figure 3:
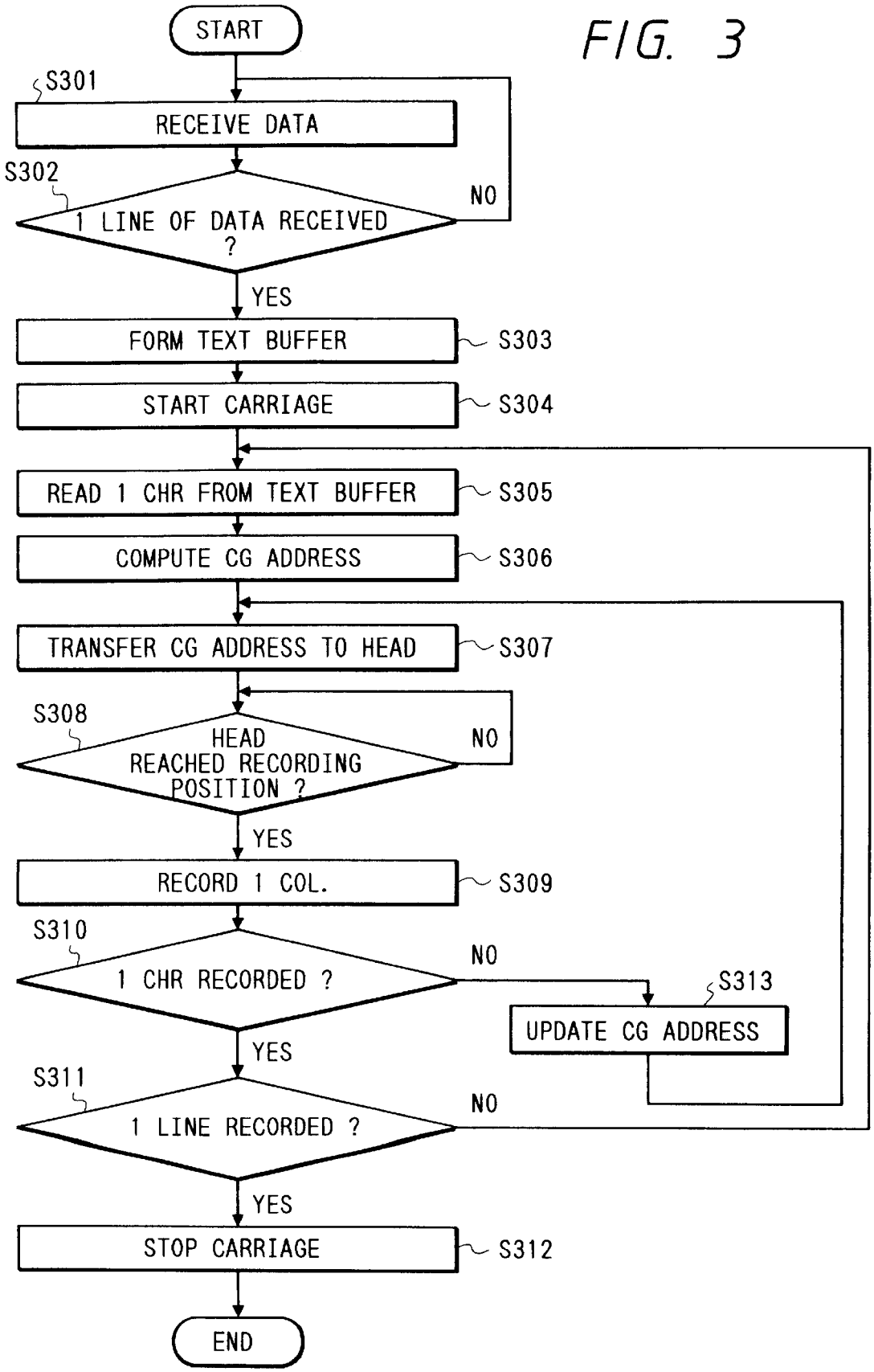
FIG. 3 is a flow chart of a recording operation of the structure shown in FIG. 1.

The recording operation of the above-explained structure will be explained in the following, with reference to a flow chart shown in FIG. 3. At first in steps S301, S302, the MPU 1 receives the character codes to be recorded from the host system through the I/F control circuit 4, and, in a step S303, stores the received data in a text buffer in the RAM 2. More specifically, the MPU 1 searches control data in the RAM 2, and, upon recognizing a recording start condition such as a line feed command or a carriage return command, or namely recognition of reception of data of a line, the MPU 1 arranges the character codes of a line in the recording direction in the text buffer of the RAM 2. Then a step S304 activates a carriage supporting the recording head, thereby initiating the scanning motion in the horizontal direction. Before the recording head reaches the recording position, steps S305, S306 read the character code of a character from the text buffer and calculate the address of the character generator. Then a step S307 transfers the address of the CGROM 7 corresponding to said character code to the CGROM 7 through the head interface 5. The structure can be simplified because the head interface can be composed of a simple register. The CGROM 7 generates a character pattern corresponding to the input address, and the signals of said pattern are supplied to AND gates corresponding one-to-one to the outputs of the CGROM 7.

When a step S308 identifies the arrival of the recording head at the recording position, a step S309 forms an actual drive timing pulse based on the pulse from the recording timing generator. In response to said pulse and input signals from the CGROM 7, the AND gates 8 release AND signals which are supplied to the driver array 9 for selectively generating heat in the heater elements 10, thereby effecting the recording operation for a vertical column of the discharge openings on the recording head.

If the next recording position is a next column in the same character, in a step S313 the MPU 1 renews the address of the CGROM 7 by adding or subtracting "1" according to the scanning direction, and effecting the recording operation by transferring said renewed address to the recording head. When a step S310 identifies the completion of recording of a character after repetition of these operations, the MPU 1 calculates the address of the CGROM 7 based on the character code stored in the text buffer of the RAM 2, and sends said address to the CGROM 7 thereby effecting the recording operation as explained above. These operations are repeated in consecutive recording positions, and, when a step S313 identifies the completion of recording of a line, a step S312 stops the carriage, thereby terminating the recording of this line.

Figure 2:
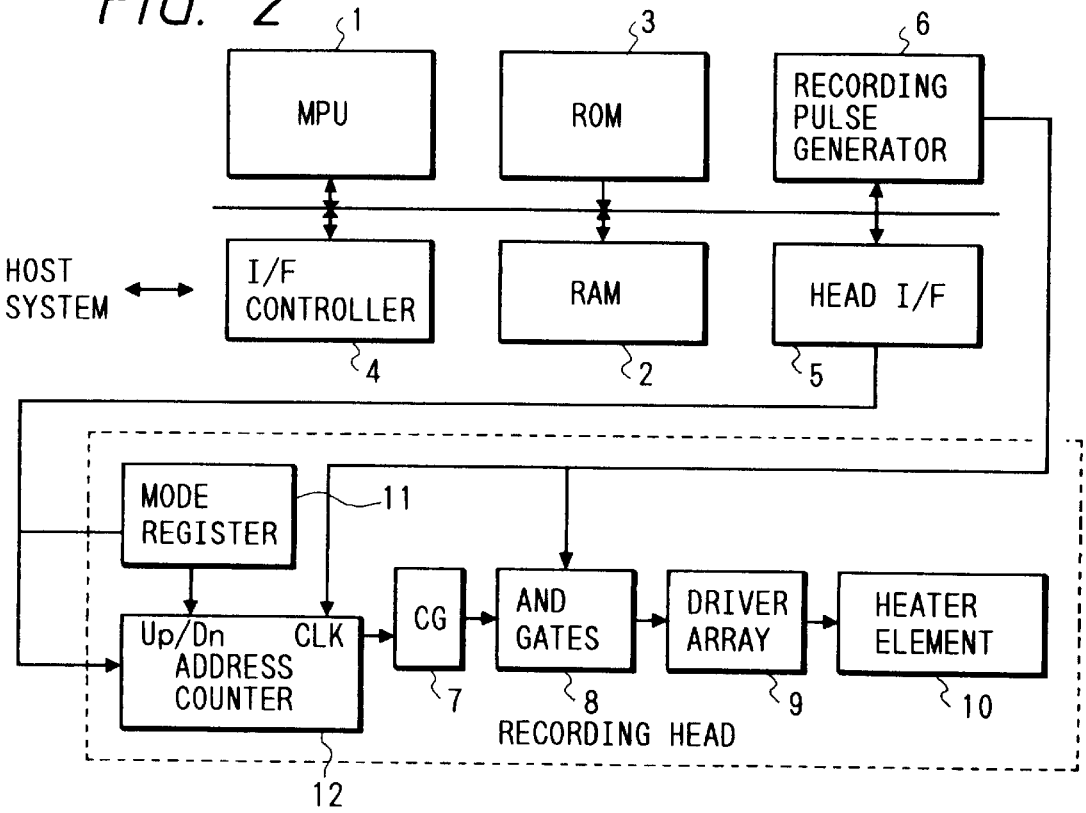
FIG. 2 is a similar block diagram of another embodiment of the present invention.

FIG. 2 shows another embodiment for achieving easier access by adding, to the recording head, an address generating device for the CGROM. The data in the CGROM are generally given continuous addresses in a character, corresponding to the columns of arrangement of discharge openings of the recording head in order to facilitate the access. Consequently, in a same character, the access to the CGROM can be made simply with a counter.

In FIG. 2, same components as those in FIG. 1 are represented by same numbers and will not be explained further. There are additionally provided a mode register 11 for retaining recording mode data transmitted from the MPU 1 through the I/F unit 5; and an address counter 12 composed of an up-down counter for generating the addresses of the CGROM 7.

The recording operation in the above-explained structure is conducted in the following manner. Before entering the recording operation, the MPU 1 sets, in the mode register 11, information whether the recording direction is forward or reverse. After the start of scanning motion of the carriage but before the arrival of the recording head at the recording position, the MPU 1 calculates the address for the CGROM 7 from the character code edited in the RAM 2, and loads the address counter 12 with said address. The output of the address counter 12 serves as an address input to the CGROM 7, which, in response, releases a bit map image of the designated character. The heater elements are driven as in the first embodiment, in response to the output of said CGROM 7 and that of the recording pulse generator 6.

The address counter 12 effects a count-up or count-down operation at the trailing end of each heating pulse, thereby making access to the data of next column. Upon completion of recording of a character, the MPU 1 loads the address counter 12 with an address of initial access for the next character before the next head drive. Thereafter the recording of a character pattern is conducted with advancement of address for the CGROM 7 at each timing of recording.

In the following there will be calculated the number of bus accesses of the MPU when a CGROM storing character bit map patterns is provided in the recording head, for example in case of access to data of a character.

Figures 7, 7A:
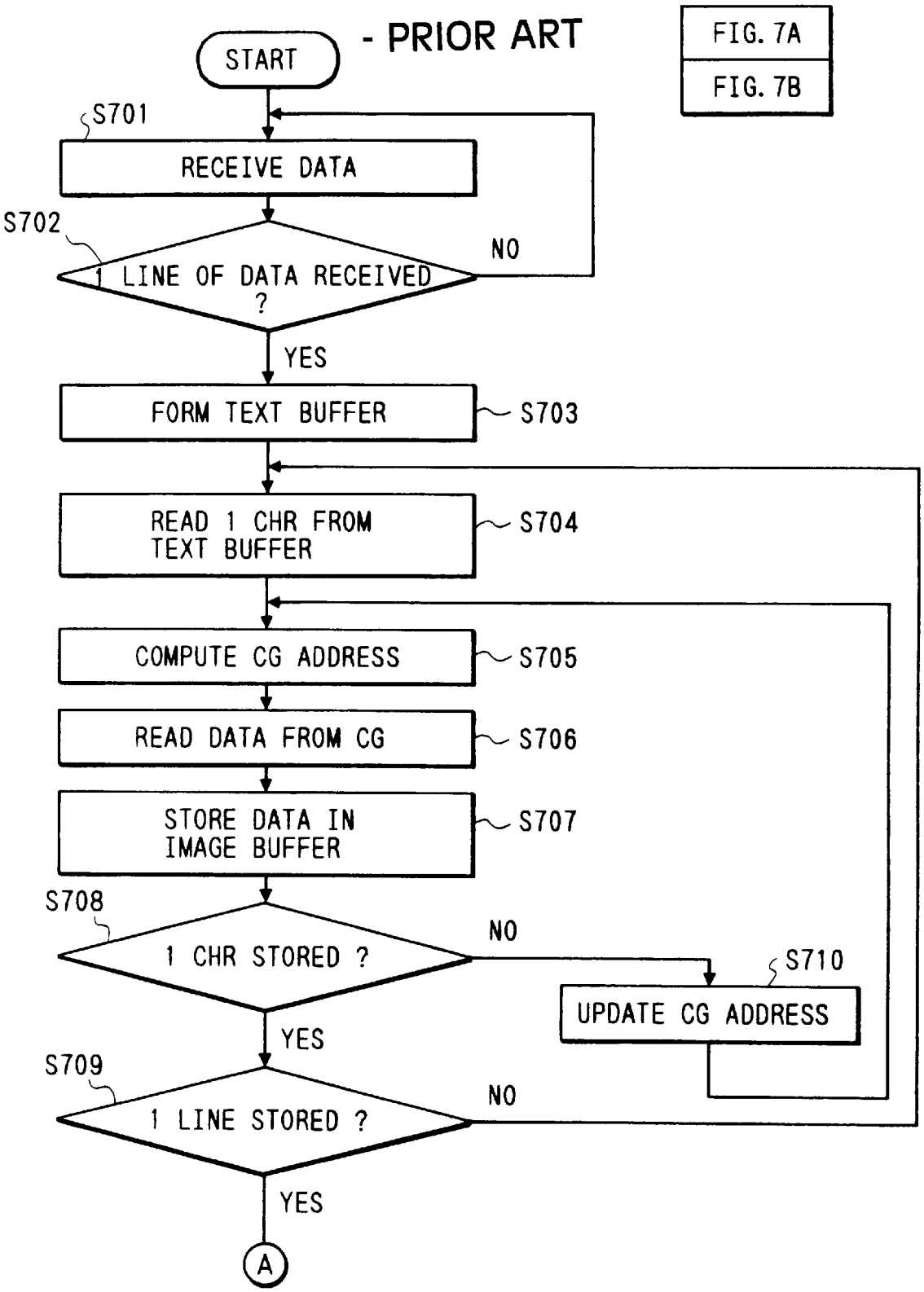
FIG. 7, consisting of FIGS. 7A and 7B, is a flow chart of a recording operation of the structure shown in FIG. 5.

Let us consider a case of a character pitch of 1/10 inches, a recording head with 64 discharge openings arranged with a pitch of 360 dpi, and an MPU having a bus width of 8 bits. In the conventional structure shown in FIG. 5, there are required 9,216 accesses according to the flow chart shown in FIG. 7. On the other hand, the 1st embodiment of the present invention requires only 72 accesses, and the 2nd embodiment requires only 2 accesses.

These figures do not consider the accesses for program reading or for the RAM functioning as the working area. In practice, the program itself may be simplified, so that the amount of data passing through the bus, or the burden on the MPU, can be further reduced.

Figure 4A:
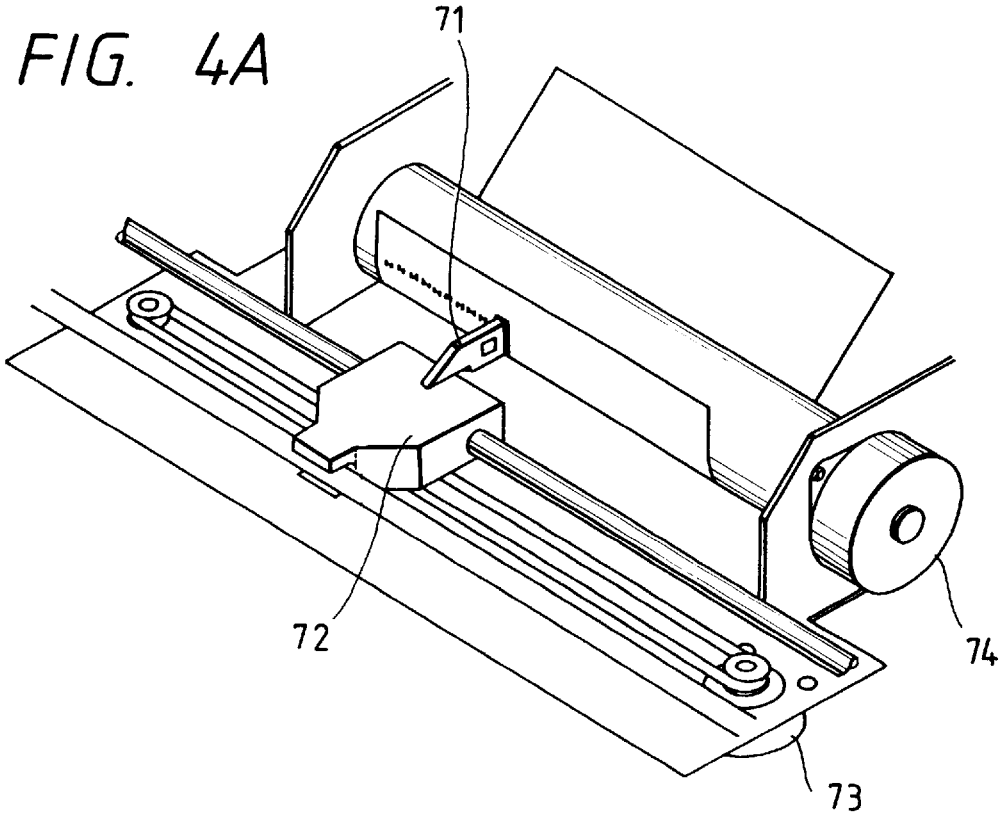
FIGS. 4A and 4B are schematic perspective views respectively of an ink jet recording apparatus having an ink jet recording head of the present invention, and of such ink jet recording head.
Figure 4B:
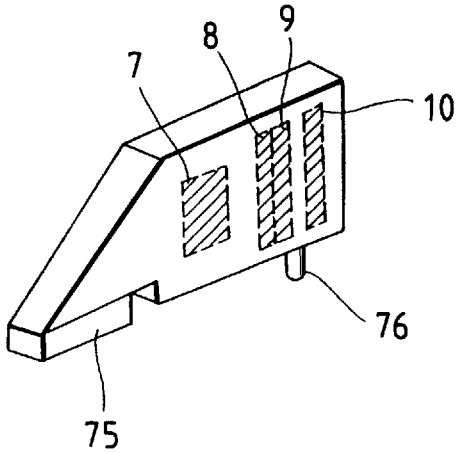

FIGS. 4A and 4B are schematic perspective views of an ink jet recording apparatus and an ink jet recording head, corresponding to FIG. 1.

In FIG. 4A, an ink jet recording head 71 is provided with 64 discharge openings aligned vertically as explained above, and has heater elements (electrothermal converters) 10 respectively corresponding to said openings. A carriage 72 supports the recording head 71 and moves horizontally, namely in the transversal direction of a recording sheet positioned opposite to said discharge openings. A carriage motor 73 serves to drive the carriage 72 through a belt.

In FIG. 4B there are shown a connector 75 for connecting the recording head 71 with the main body as explained in FIG. 1, and an ink joint 76 for supplying the recording head 71 with ink. Also the CGROM 7, AND gates 8, driver array 9 and heater elements 10 are provided in the form of a circuit board.

Said recording head 71 is easily detachable by means of the connector 75 and the ink joint 76, and is fixed, when mounted, to the carriage 72 by means of unrepresented support means. Such structure enables interchanged use of plural heads. Thus a font other than the standard one may be realized by mounting a recording head provided with a CGROM storing such font.

As explained in the foregoing, the present invention is applicable to various recording apparatuses, but provides excellent advantages particularly in the ink jet recording method, more particularly in the bubble ink jet recording head which has the capability for high-quality and high resolution recording.

The structure of such recording head is preferably based on the basic principle disclosed for example in the U.S. Pat. Nos. 4,723,129 and 4,740,796.

Said bubble jet recording method is applicable to either of so-called on-demand type or continuous type apparatuses, but is more advantageously applicable to the on-demand type in that at least a drive signal causing a rapid temperature increase exceeding the boiling point is given, corresponding to the recording information, to an electrothermal converter positioned corresponding to a sheet or a liquid path holding the liquid ink, thereby causing said converter to generate thermal energy and inducing film boiling on a heating face of the recording head and forming a bubble in said ink corresponding one-to-one to said drive signal. The expansion or contraction of said bubble causes the discharge of the ink from a discharge opening, thereby forming at least a liquid droplet.

The use of a pulse-shaped drive signal is particularly preferable in that such signal can cause charge. Preferred examples of such pulse-shaped drive signal are disclosed for example in the U.S. Pat. Nos. 4,463,359 and 4,345,262.

Also more excellent recording can be achieved by employing a condition concerning the temperature elevation rate of said heating plane disclosed in the U.S. Pat. No. 4,313,124.

The structure of the recording head includes not only the combination of discharge opening, liquid path and electrothermal converter (with linear or rectangularly bent liquid path) as disclosed in the foregoing embodiments, but also the structure having the heating area in the bent portion, as disclosed in the U.S. Pat. Nos. 4,558,333 and 4,459,600. In addition, the present invention is effective also in a structure in which the discharge opening is composed of a slit common to plural electrothermal converters as disclosed in the Japanese Laid-open Patent Application No. 59-123670, or a structure in which an aperture for absorbing the pressure wave of thermal energy is provided corresponding to the discharge opening, as disclosed in.,the Japanese Laid-open Patent Applications No. 59-138461.

Furthermore, though the foregoing embodiments employ a so-called serial type recording head, there may also be employed a full-line recording head of a length corresponding to the width of the widest recording medium usable with the recording apparatus. Such recording head may be formed by the combination of plural recording heads as disclosed in the above-cited patents or may be formed as an integral recording head, and the present invention can exhibit the above-explained advantages in any of such recording heads.

The present invention is furthermore effective in a replaceable chip-type recording head which can be electrically connected to the main body of the apparatus and can receive ink supply therefrom upon mounting therein, or a cartridge type recording head in which an ink tank is integrally provided on the recording head.

The recording apparatus of the present invention is preferably provided with recovery means for the recording head and other auxiliary means in order to maintain satisfactory recording. Examples of such means include capping means, cleaning means, pressurizing means and preliminary heating means for the recording head. Also a preliminary ink discharge mode, in which ink discharge other than that for recording is conducted, is effective for stable recording.

The present invention is effective not only for the recording mode with a main color such as black color, but also for plural-color recording or full-color recording regardless whether the recording head is of an integral structure or is composed of the combination of plural heads.

As will be apparent from the foregoing description, the present invention is characterized by a fact that the character generator is provided on the recording head, whereby the head drive control means, composed for example of an MPU, is only required to transfer the address data for the character generator but is relieved from the tasks of reading the character generator data or recording into the buffer, so that the burden of the MPU is significantly reduced.

For this reason an ordinary MPU can cope with the recording operation with a high resolving power or with a recording head having a large number of recording elements.

Furthermore, since the amount of data to be transferred to the recording head is reduced, there can be reduced the number of lines connecting the recording head with the main body of the apparatus.

Also since plural recording heads can be interchanged in the course of recording, there may be changed the content of the character generator and the recording can be made with various fonts.

The reduced burden on the MPU enables the use of an inexpensive CPU without complex peripheral circuitry, thereby reducing the cost of the control unit of the recording apparatus. In addition the number of lines between the head and the circuit board in the main body can be reduced, and a different font can be achieved by mere change of the recording head, without a connector for a font card or a space for such connector. Consequently there can be expected the advantage of compactization of the recording apparatus itself.

What is claimed is:

1. A recording head detachably mounted on a recording apparatus, said head comprising:

counting means for updating an address, received from the recording apparatus, to be accessed first for a certain character each time a recording pulse is received from the recording apparatus;

recording means for recording data on a recording medium based on the character pattern transmitted by said character generating means and the recording pulse received from the recording apparatus; and character generating means for transmitting a character pattern, corresponding to the address updated by said counting means, to said recording means.

2. A recording head according to claim further comprising register means for storing information for determining whether said recording means records data in one of a forward direction and a reverse direction, wherein said counting means increases or decreases the address in response to the information stored in said register means each time said recording means records one column.

3. A recording head according to claim 1, wherein said recording means comprises an element which creates a bubble in an ink by generating heat and ejects a drop of the ink by means of a change in pressure due to the bubble.

4. A recording apparatus comprising:

a recording head detachably mounted on said recording apparatus, said head comprising;

counting means for updating an address, received from said recording apparatus, to be accessed first for a certain character each time a recording pulse is received from said recording apparatus;

recording means for recording data on a recording medium based on the character pattern transmitted by said character generating means and the recording pulse received from the recording apparatus; and character generating means for transmitting a character pattern, corresponding to the address updated by said counting means, to said recording means; and a carriage for mounting said recording head on said recording apparatus.

5. A recording apparatus according to claim 4, wherein said recording head further comprises register means for storing information for determining whether said recording means records data in one of a forward direction and in a reverse direction, wherein said counting means increases or decreases the address in response to the information stored in said register means each time said recording means records one column.

6. A recording apparatus according to claim 4, wherein said recording means comprises an element which creates a bubble in an ink by generating heat and ejects a drop of the ink by means of a change in pressure due to the bubble.

* * * * *